United States Patent [19]

Harris

[11] 4,455,019

[45] Jun. 19, 1984

[54] EXERCISER FOR FINGER, HAND, WRIST AND FOREARM

[76] Inventor: John E. Harris, 4666 Longfellow Dr., New Orleans, La. 70127

[21] Appl. No.: 397,458

[22] Filed: Jul. 12, 1982

[51] Int. Cl.[3] ..... A63B 23/00

[52] U.S. Cl. ..... 272/67

[58] Field of Search ..... 272/67, 68, 117

[56] References Cited

U.S. PATENT DOCUMENTS

| | | | |
|---|---|---|---|
| 623,592 | 4/1899 | Bonney | 272/67 |
| 2,706,632 | 4/1955 | Chandler | 272/117 X |
| 4,253,660 | 3/1981 | Tiktin | 272/67 |

*Primary Examiner*—Richard J. Johnson

*Attorney, Agent, or Firm*—Keaty & Keaty

[57] ABSTRACT

An improved exerciser for finger, hand, wrist and forearm is provided with a frame having a hand supporting portion, a first set of pulleys mounted on a frame adjacent the hand supporting portion, and a second second set of pulleys mounted on said frame remote from said hand-supporting portion. A plurality of weight supporting cables are provided having finger-receiving loops at one end and weights attached to the other end. Each of these cables is disposed around a first pulley and a second pulley such that the weights provide resistive force to fingers inserted through the loops when the fingers are flexed. This structure provides an improved apparatus for strengthening the fingers, hand, wrist and forearm, especially following traumatic injury to the hand.

12 Claims, 6 Drawing Figures

EXERCISER FOR FINGER, HAND, WRIST AND FOREARM

BACKGROUND OF THE INVENTION

1. Field of the Invention

The present invention relates to an exercising device and especially to exercise and therapeutic devices for hands, arms and fingers (Class 272 Subclasses 67 and 68). More particularly, the present invention relates to a device for providing resistive exercises for the hand and associated anatomic parts by providing a frame having two sets of pulleys mounted thereon. A weight-supporting cable having a weight at a first end and a finger receiving loop at a second end is threaded around one pulley from each of the sets, thereby providing weighted opposition to extension or flexion of the finger.

2. General Background

It has long been recognized that it is possible to strengthen the muscles, tendons, and ligaments of a human hand by providing gentle, resistive exercises over a period of time. It has been found especially desirable to provide a device for gradually increasing the resistance offered to the fingers being flexed in order to provide a suitable degree of exercise to the joints being flexed. Especially in the instance of post-traumatic recovery, it is important to provide increasing resistance to flexion during the period when the muscles, tendons and ligaments of the hand are recovering from the injury. Finger and wrist exercisers have also been suggested which would provide exercise for a healthy hand, such a device being used by musicians, atheletes or other persons requiring a high degree of manual dexterity and strength in their professions.

An early attempt to provide a finger exercising machine is found in U.S. Pat. No. 318,916 issued to Liebig. This patent discloses a finger exercising machine comprised of a baseboard having pivoted key levers and a supporting top bar, the pivotal bars being pressed toward the base in opposition to a resilient connection between the keys and the supporting top bar. The supporting legs of the crossbar are telescopically received in upright supports, thereby providing for adjustability of the distance between the crossbar and the keys. This feature permitted adjustable variation in the degree of resistive effort provided to the fingers being exercised.

Another patent disclosing a musician's finger strengthener is found in U.S. Pat. No. 638,632 issued to Griffin. The Griffin patent disclosed a plurality of rings each suspended from a flexible cord, the fingers being placed through the rings and pulled against the bias of the cord to provide exercise for the finger.

U.S. Pat. No. 3,782,719 provided an exercising device having a base member on which the forearm was adapted to rest. Finger loops carried by the device were disposed near the forearm-receiving portion of the machine, the loops being adapted for receiving the fingers of the hand. The loops were connected to cords which were disposed around a pulley and each of the cords was in turn attached to a biasing spring for providing resistive effort to the fingers when the loops were pulled against the biased springs.

U.S Pat. No. 3,871,646 issued to Slack provided another therapeutic machine for exercising the hands and fingers. It was comprised of a base having finger-receiving loops mounted adjacent a hand rest. The finger-receiving loops were secured to cords which were in turn connected to coil springs. A series of pins were mounted in the base adjacent the loops in order to provide a means for increasing the resistance to flexion or extension of the fingers.

U.S. Pat. No. 4,220,327 issued to Herbowy for a hand wrist exerciser and disclosed a pair of opposing side uprights having a plurality of elongated tensioned elastic members extending therebetween. The forearm and or wrist of a user could be braced against the upper surface of a rest and the fingers gripped around the tensioned elastic members for providing resistive effort to fingers being flexed.

French Pat. No. 445,978 also discloses an exercising device for the finger which is provided which elastomeric cords.

GENERAL DISCUSSION OF THE PRESENT INVENTION

The preferred embodiment of the apparatus of the present invention provides a device for exercising the finger, thumb, hand, wrist and forearm, thereby providing a useful therapeutic device for persons recovering from traumatic injury to the hand and its associated anatomic parts. The present device is also useful for athletes, musicians, surgeons, typists and other persons requiring a high degree of manual dexterity in their professions.

Although there are many devices in the prior art for exercising the fingers, these prior devices have all suffered from an inability to provide a gradual predictable increase in the degree of resistive effort provided to the fingers during exercising. This inability to accurately alter the degree of resistance is a function of the prior art's reliance on elastic or coiled tensioning means for providing resistance. It is not possible to accurately alter the weight against which the finger is pulled when only elastic or coiled tensioning means are being used. This problem has been solved in the instant invention by the provision of selectively detachable weights against which the fingers pull. A series of weights can be provided over a very broad range to permit great flexibility in the amount of effort required to flex or extend a finger against the resistive pull of the weight.

Furthermore, some of the prior art devices are limited to exercise with the hand in the palm-down position and do not provide any exercise for the hand in the opposite position. Accordingly, there is a need for a device of the sort provided by the present apparatus wherein the fingers may be exercised both through flexion and extension.

Another distinct disadvantage found in the prior art is the inability of prior art machines to be readily adapted for use by patients having different size arms, hands and wrists.

Accordingly, it is an object of the present invention to provide a finger exercising device which may be used in the exercising of the fingers individually or in clusters, and in either the palm-up or palm-down position of the hand.

Another object of this invention resides in the simple adjustment of the tension on each finger which can be accomplished by attaching weights of varying heaviness to provide different degrees of resistive force to fingers being flexed or extended. This feature offers initial gentle resistance by the exerciser with increasing resistance being available as the patient's strength gradually increases during recovery.

A further object to this invention is to provide an exerciser wherein different patients may successively use the same exerciser to carry out exercises of different resistance.

Another object is to provide an exerciser readily adaptable to different size hands.

These objects together with other objects and advantages which will become subsequently apparent, reside in the details of construction and operation as more fully hereinafter described and claimed, reference being had to the accompanying drawings forming a part hereof, wherein like numerals refer to like parts.

DETAILED DESCRIPTION OF THE PREFERRED EMBODIMENT

Figure 1:
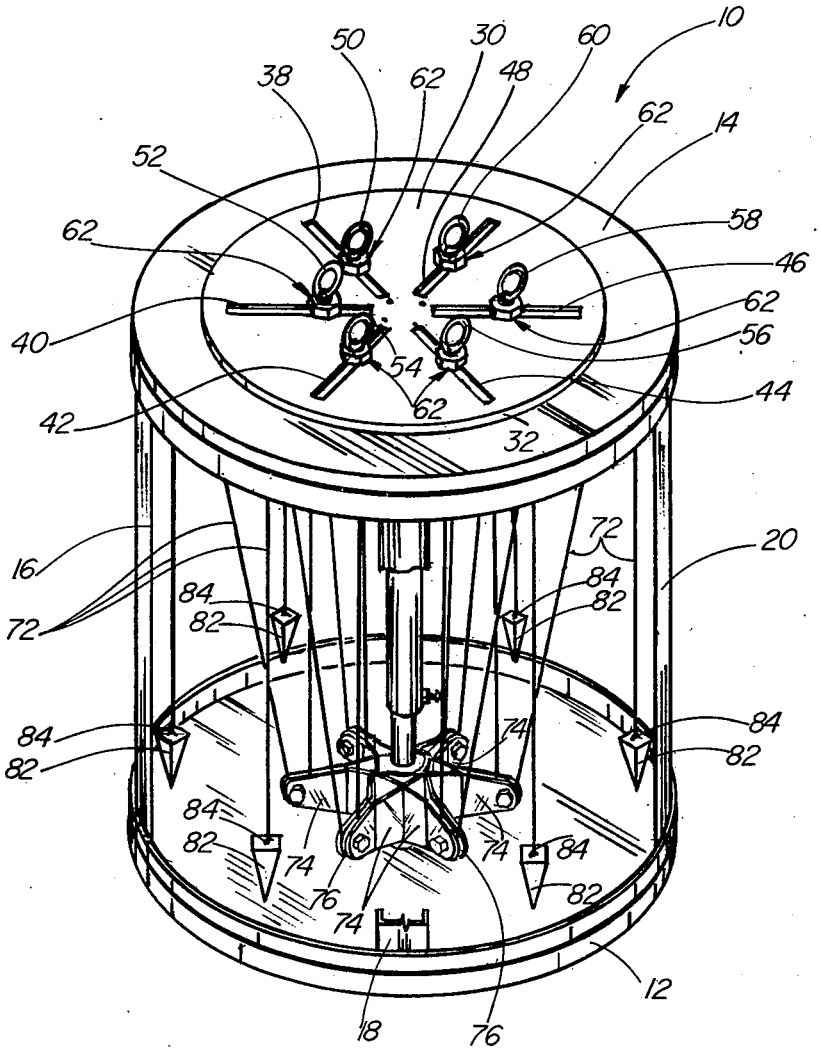
FIG. 1 is a perspective view of a first embodiment of the finger exerciser, parts being cut away for clarity.
Figure 2:
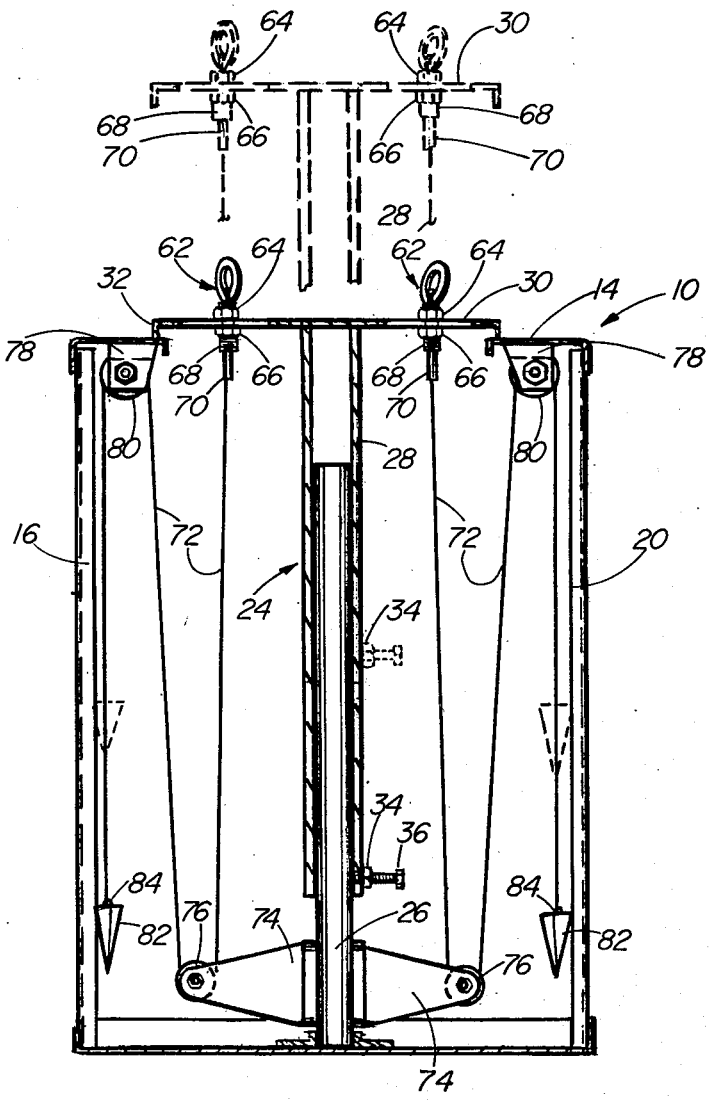
FIG. 2 is a cross sectional view of the device shown in FIG. 1, the lid being depicted in a removed disposition in phantom lines.

An exerciser 10 is shown in FIGS. 1 through 4, and is provided with a circular base 12 and corresponding circular top 14. Base 12 and top 14 are held in spaced parallel relationship by a plurality of struts 16, 18, 20 and 22 (part of strut 18 being broken away for clarity, strut 22 being hidden in FIGS. 1 and 3). Base 12 and top 14 are also maintained in spaced parallel relationship by a central, upright support column 24 (best seen in FIG. 2). Column 24 is comprised of an internal tubular element 26 which is fixed to the center of base 12 and extends upwardly therefrom approximately ¾ the height of exerciser 10, and an external tubular element 28 depending from lid 14 and slidably receiving element 26 therewithin.

Top 14 is further provided with a selectively removable round lid 30 having an annular, downwardly depending flange 32 for seating against top 14. Element 28 is integral with lid 30 and depends downwardly therefrom, being adapted to receive element 26 when lid 30 is selectively fixed with in exerciser 10. Internally threaded nut 34 (see FIG. 2) has set screw 36 threadably engaged therethrough to maintain element 26 and element 28 in snug engagement.

Lid 30 is additionally provided with six radial slots 38–48, immediately adjacent slots being separated by an angle of about 60°. For instance, the angle between slot 38 and slot 40 would be approximately 60°. Each of the slots 38–48 has a finger receiving loop 50–60 emerging therethrough, loops 50–60 being threaded through eyelet fasteners 62, each of fasteners 62 being comprised of a top nut 64, bottom nut 66, and externally threaded tubular member 68. Nuts 64, 66 can be selectively tightened against slots 38–48 in lid 30 to maintain loops 50–60 at a fixed position along slots 38–48. Fasteners 62 are further provided with a sheath 70 for guiding a cable, to be described below, beyond the lower terminus of member 68.

Each of the loops 50–60 is tied to one terminus of a cable 72 which is made of any flexible, non-stretching material, such as cord or flexible plastic coated wire, which will ride without difficulty through fasteners 62.

Generally V-shaped pulley blocks 74 are placed in surrounding relationship to element 26, adjacent base 12, the angle between each block and its immediately adjacent block being on the order of 60°. For instance, if an imaginary line were drawn from the center of lid 30 radially outwardly to the position of each block, the angle subtended by adjacent imaginary lines would be on the order of 60°. In addition, blocks 74 should be substantially radially aligned with slots 38–48. The blocks 74–84 contain sheaves 76 around which cables 72 may be threaded in pulley engaging contact.

A second set of pulley blocks 78 are disposed around the inside of exerciser 10 near the line of intersection between struts 16 and top 14. There are an equal number of blocks 78 as there are blocks 74, blocks 74 and 78 being substantially aligned one above the other. Blocks 78 have a sheave 80 mounted therein to provide a groove through which cable 72 may ride.

Tetrahedral metal weights 82 are fastened to a terminus of cable 72 by means of a generally U-shaped fastener embedded in the base of weight 82 (the fastener not being shown in detail but being generally referred to as 84). Cable 72 extends from its point of attachment to loops 50–60, downwardly and around sheaves 76, thence upwardly to, over and around sheaves 80, thence downwardly to a position near the base 12 where it is attached to weights 82.

Figure 4:
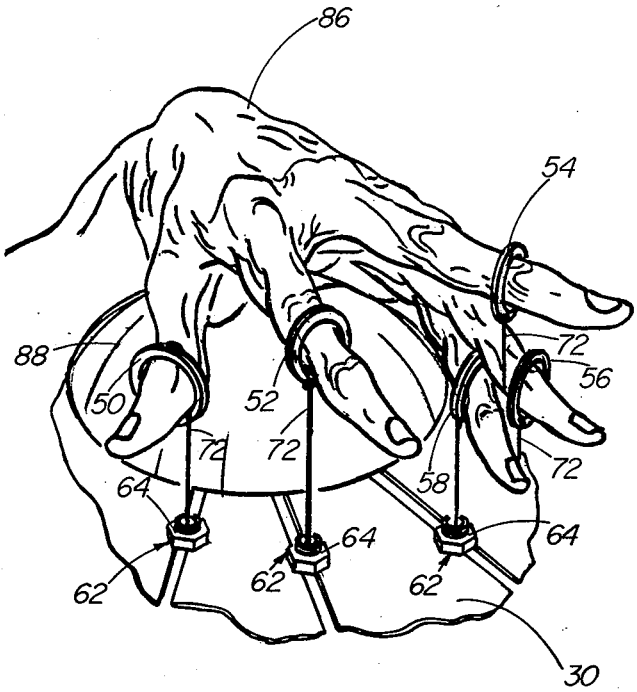
FIG. 4 is an enlarged view of a hand with the fingers disposed through the loops of the present device, the fingers being extended to pull the loops away from the lid of the device.
Figure 3:
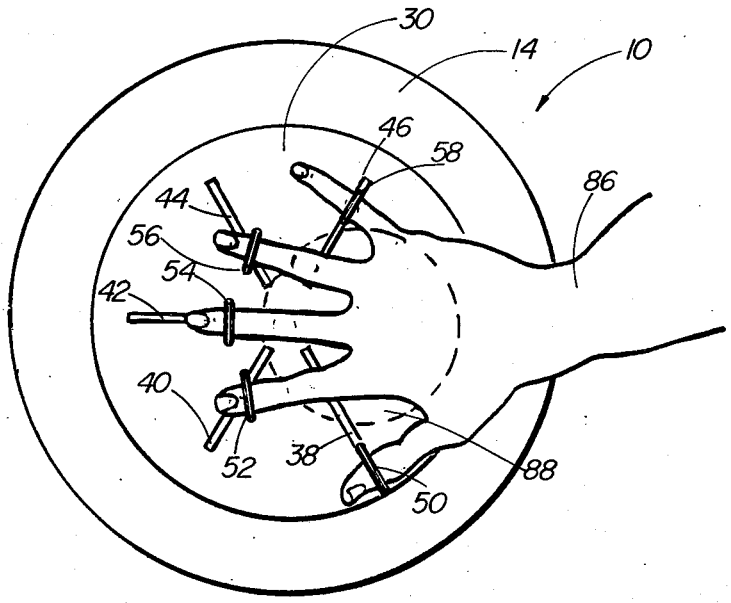
FIG. 3 is a top plan view of the device with the fingers of the hand disposed through finger-engaging loops, a handrest being depicted in phantom lines.

A diseased hand 86 is shown in FIGS. 3 and 4 with the fingers of hand 86 being disposed through loops 50–60. There is provided a hand rest 88 on which hand 86 may rest while exercises are being performed.

In operation, hand 86 is placed on hand rest 88, either palm down or palm up, the fingers of hand 86 being placed one each through loops 50–58. The relative positions of fasteners 62 may be adjusted within slots 38–46, depending on the size of the hand being exercised. If an adjustment to the size of the hand is required, nuts 64, 66 may be turned such that they advance towards the terminii of member 68, thereby moving away from engagement with lid 30. After being placed in the most comfortable position along slots 38–46, nuts 64, 66 may be tightened towards each other, thereby rendering fastener 62 relatively immobile with respect to lid 30. If the hand is in a palm down position, the fingers are extended; if the hand is in the palm up position, the fingers are flexed. Movement of the fingers in this manner causes the weights 82 to present gentle resistive force to the attempted movement of the fingers, thereby strengthening the muscles, tendons and ligaments involved in the attempted flexion or extesion. As the hand and associated anatomic parts are strengthened by the exercises, weights 82 having different degrees of heaviness may be substituted for the lighter weights, thereby providing a gradual increase in the degree of resistive force provided to the fingers being exercised.

Figure 6:
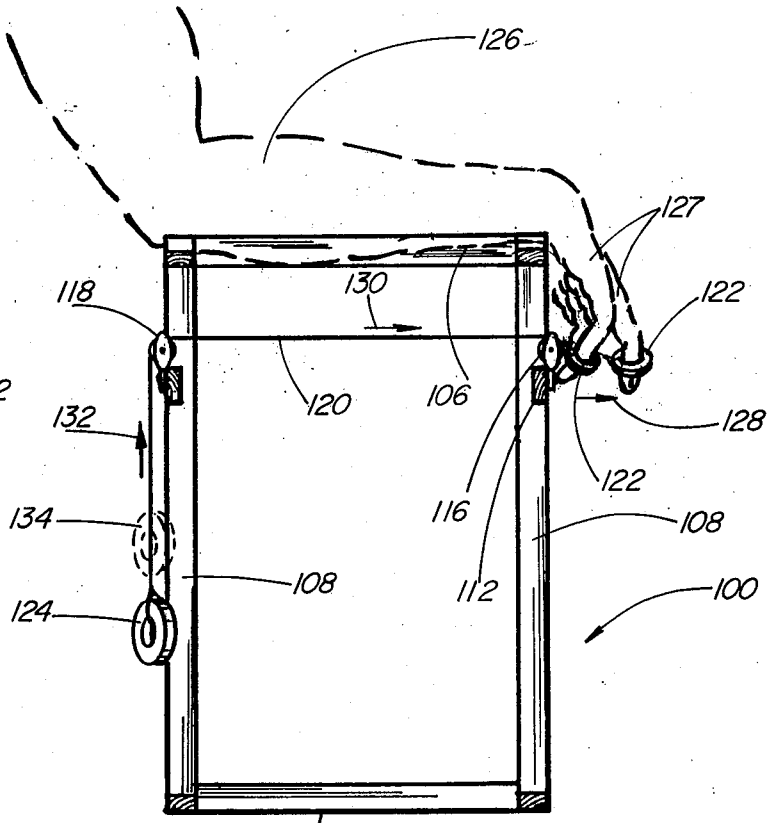
FIG. 6 is a cross sectional view of the device shown in FIG. 5 taken along line 6—6, the arm and hand of a person being shown as it would appear when being exercised.
Figure 5:
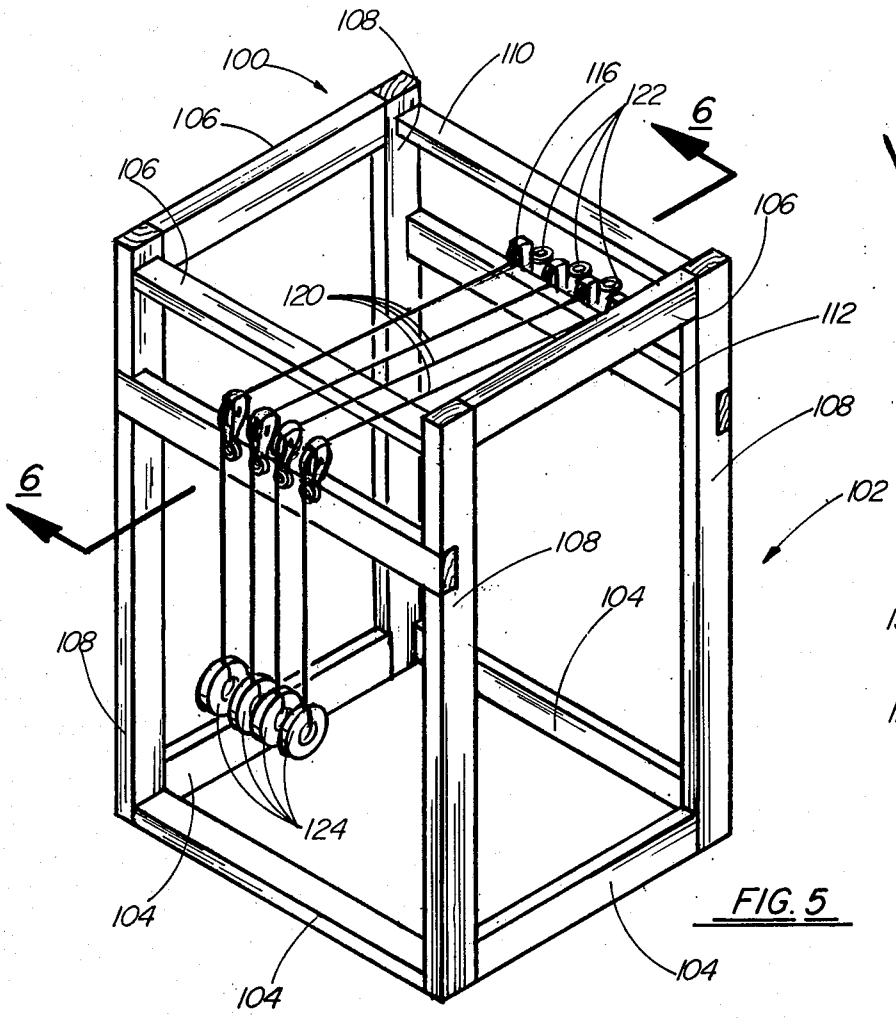
FIG. 5 is a perspective view of a second embodiment of the present invention.

A second embodiment of this invention is seen in FIGS. 5 and 6 where an exerciser 100 is provided with a parallelepiped shaped frame 102 having base beams 104 forming a square base, upper beams 106, 110 forming a square top portion, and uprights 108 forming rectangular sides in conjunction with beams 104, 106, 110.

A hand rest 110 is comprised of a generally horizontal member which forms an upper edge of said frame, similar to beams 106. Hand rest 110 is located a convenient distance from the finger-receiving loops, described below, to permit the hand to rest of top of hand rest 110, and fingers to reach down to the loops.

Frame 102 is further provided with first generally horizontal beam 112 and second generally horizontal beam 114. Beam 112 is substantially parallel to hand rest 110 in the same upright face of the parallelepiped as hand rest 110. Second beam 114 is aligned to beam 112 in opposed parallel relationship to beam 112, except it is located in the upright face of the parallelepiped opposing the face containing beam 112. Beams 112, 114 are both located a substantially equal distance from the base of frame 102, about 2 inches below hand rest 110.

A first set of pulleys 116 are mounted on beam 112 of frame 102, in spaced parallel relationship, the central axis of pulleys 116 being parallel to the face of the parallelepiped containing beam 112. Four pulleys are shown in FIG. 5, and they are mounted such that the pulley blocks of pulleys 116 extend upwardly from beam 112 towards hand rest 110.

A second set of pulleys 118 are mounted in spaced parallel relationship on beam 114, the central axis of pulleys 118 being parallel to the face of the parallelepiped containing beam 114. In the embodiment shown in FIGS. 5 and 6, there are four pulleys in first set 116 and four pulleys in second set 118. This number of pulleys provides facilities for the exercise of the fingers of the hand, excluding the thumb.

In addition, four weight supporting cables 120, each having finger-receiving loops 122 at one end and circular weights 124 at another end, are each disposed around one of first pulley 116 and second pulley 118 to provide resistive force to fingers inserted through loops 122 and being flexed. Loops 122 are disposed on the side of the pulley block opposing the face of the parallelepiped, and loops 122 are prevented from passing through the housing of pulley 116 by means of a small knot tied adjacent loop 122 on the side of the housing away from the face of the parallelepiped. Cables 120 are disposed around the top of pulleys 118 and allowed to dangle such that weights 124 are maintained in spaced parallel relationship to the other disks.

In operation (see FIG. 6), a hand 126 is placed on the hand rest, in either a palm up or palm down position. In the embodiment shown in FIG. 6, the hand is placed in a palm down position with the butt of the hand resting against the side of the beam 112. The fingers 127 are allowed to depend towards loops 122, and the fingers 127 are inserted through said loops 122. When exercising begins, the fingers are pulled in the direction of arrow 128, thereby moving cable 120 in the direction of cable arrow 130. The movement of the cable raises weights 124 in the direction of weight movement arrow 132, thereby raising weights 124 from their stationary position to a finger flexed or finger extended position shown in phantom at 134. Weights 124 may be replaced by weights of varying heaviness to provide different degrees of resistive force to the extension or flexion of fingers 127.

In addition to the above, other finger, hand, wrist and forearm exercises may be accomplished.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to which fall within the scope of the invention:

What is claimed as invention is:

1. A finger, thumb, hand, wrist and forearm exerciser comprising:

a. a cylindrical frame having a circular base, a circular lid; a central upright support column, the longitudinal axis of said column being coincident with the longitudinal axis of said cylindrical frame; a hand supporting portion provided with an inverted cup centrally disposed on said lid, said lid having a plurality of radially extending slots, each of said slots having one finger-receiving loop extending therethrough;

b. a first set of pulleys mounted on said frame adjacent said hand supporting portion;

c. a second set of pulleys mounted on said frame remote from said hand supporting portion, each pulley of said second set having a single corresponding pulley in said first set;

d. a plurality of weight supporting cables each having finger receiving loops at a first end and weights attached to a second end, each of said cables being disposed around one of said first pulleys and one of said second pulleys for providing resistive force to fingers inserted through said loops and being flexed.

2. The apparatus of claim 1 wherein each of said first set of pulleys is disposed adjacent the inner wall of the cylinder near the line of intersection between said walls and said lid, each of said first set of pulleys being substantially equidistant from the immediately adjacent pulleys on both sides, said second set of pulleys being disposed in surrounding relationship to said support column and adjacent said base, each of said second set of pulleys being substantially equidistant from the immediately adjacent pulleys on both sides.

3. The apparatus of claim 2 wherein said second end of each of the cables is disposed in pulley-engaging relationship around the top of one of said first set of pulleys, each of said cables extending the height of the frame and said second end of the cable being disposed in pulley engaging relationship around the bottom of one of said second set of pulleys.

4. The apparatus of claim 3 wherein each of said weights are comprised of a metal tetrahedron having a fastener disposed in the base thereof for securing said second end of the cable to said weight.

5. The apparatus of claim 4 wherein each of said first and second set of pulleys are comprised of six pulleys.

6. The apparatus of claim 5 wherein said finger-receiving loops are secured in said slots at a selectively fixed position by eyelet fasteners.

7. A finger, thumb, hand, wrist and forearm exerciser comprising:

a. a frame in a form of parallelepiped having a rectangular base and rectangular sides; a hand supporting portion being comprised of a generally horizontal member which forms an upper edge of said frame:

b. a first and second generally horizontal beams mounted below said upper edge of said frame, said first beam being mounted in the same vertical plane and in substantially parallel relationship to said hand supporting member, said second beam being aligned in opposed parallel relationship to said first beam in the vertical plane passing through the opposing upright face of said parallelpiped, said first and second beams being located equidistantly from the base of said frame;

c. a first set of pulleys, each of said pulleys being mounted in spaced parallel relationship on said first beam;

d. a second set of pulleys, each of said pulleys being mounted in a spaced parallel relationship on said second beam;

e. a plurality of weight supporting cables each having a finger receiving loop at a first end and a weight attached to a second end, each of said cables being disposed around one of said first pulleys and one of said second pulleys for providing resistive force to fingers inserted through said loops and being flexed.

8. The apparatus of claim 7, wherein each of central axes of said first pulleys is parallel to the first beam containing face of said parallelepiped.

9. The apparatus of claim 7, wherein each of central axes of said second pulleys is parallel to the second beam-containing face of said parallelepiped.

10. The apparatus of claim 9 wherein each of said first and second sets of pulleys are comprised of four pulleys.

11. The apparatus of claim 10 wherein said first end of each of the cables is disposed in pulley-engaging relationship around the bottom of one of said first set of pulleys, each of said cables extending transversely to the frame and being disposed in pulley-engaging relationship around the top of one of said second set of pulleys.

12. The apparatus of claim 11 wherein each of said weights is comprised of a cylindrical metal disk, each of said disks being suspended from one of the cables disposed around the top of one of said second set of pulleys, each of said disks thereby being maintained in spaced parallel relationship to the other disks.

* * * * *